United States Patent [19]

Nieuwendijk et al.

[11] Patent Number: 4,544,806

[45] Date of Patent: Oct. 1, 1985

[54] RIBBON-TYPE TRANSDUCER WITH A MULTI-LAYER DIAPHRAGM

[75] Inventors: Joris A. M. Nieuwendijk; Wilhelmus D. A. M. van Gijsel; Georgius B. J. Sanders, all of Eindhoven, Netherlands

[73] Assignee: U.S. Philips Corporation, New York, N.Y.

[21] Appl. No.: 584,706

[22] Filed: Feb. 29, 1984

[30] Foreign Application Priority Data

Mar. 8, 1983 [NL] Netherlands ..... 8300835

[51] Int. Cl.[4] ..... H04R 7/06; H04R 7/18; H04R 9/00

[52] U.S. Cl. ..... 179/115.5 PV; 179/115.5 VC; 179/181 R; 179/180

[58] Field of Search ..... 179/115.5 PV, 115.5 VC, 179/115.5 DV, 115.5 PS, 115.5 R, 116, 181 R, 180; 181/157, 144, 170

[56] References Cited

U.S. PATENT DOCUMENTS 1,403,849 1/1922 Delany ..... 181/170

3,898,598 8/1975 Asahi ..... 179/115.5 ES 4,273,968 6/1981 Suyama ..... 179/115.5 PV

FOREIGN PATENT DOCUMENTS 595574 4/1934 Fed. Rep. of Germany .

*Primary Examiner*—Gene Z. Rubinson

*Assistant Examiner*—Danita R. Byrd

*Attorney, Agent, or Firm*—Robert T. Mayer; Bernard Franzblau

[57] ABSTRACT

A ribbon-type electro-acoustic transducer comprising a magnet system having a pole plate (2, 3) and a center pole (1) between which at least one air gap (8) is formed with a diaphragm (7) arranged in the air gap (8). The diaphragm comprises at least two foils (10, 11) which extend substantially parallel to each other in the diaphragm plane, every two adjacent foils being joined to each other at their circumference in an air-tight manner so that a volume (12) is enclosed. A conductor (9, 18) is arranged on each of the foils. Preferably the volume enclosed between two foils contains a damping material (22).

5 Claims, 3 Drawing Figures

RIBBON-TYPE TRANSDUCER WITH A MULTI-LAYER DIAPHRAGM

Figure 1:
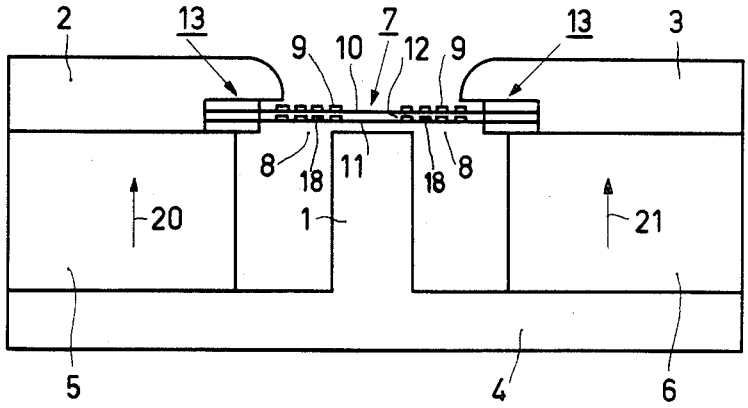

The invention relates to an electro-acoustic transducer of the ribbon-type, which transducer comprises a magnet system having a pole plate and a centre pole between which at least one air gap is formed, and a diaphragm which is arranged in the air gap and which comprises two or more foils which all extend substantially parallel to each other in the diaphragm plane, every two adjacent foils being joined to each other in a substantially air-tight manner while enclosing a volume.

Such a transducer is disclosed in U.S. Pat. No. 3,898,598. The transducer disclosed therein (see for example FIG. 3) has a diaphragm comprising three with a conductor arranged on one of the foils. The known transducer has the drawback that the distortion components in the output signal, particularly in the case of larger output signals, are fairly large and that the operating frequency range of the transducer is limited to comparatively high frequencies and the sensitivity is not very high.

The invention aims at providing an electro-acoustic transducer of the ribbon-type whose output signal distortion is reduced, whose sensitivity is high and whose operating frequency range is extended, i.e. whose operating frequency range is extended towards lower frequencies. To this end an electro-acoustic transducer in accordance with the invention is characterized in that a conductor is arranged on each of the foils and the conductors are electrically arranged in such a manner that all the foils move at least substantially in phase with each other when an electric signal is applied to the transducer.

The step in accordance with the invention is based on the recognition of the fact that the operating frequency range can be extended on the low-frequency end by enlarging the conductor mass, not by making the conductors on one of the foils thicker (which would produce more distortion) but by also arranging a conductor on the additional foil(s). The conductors may then be arranged in series or in parallel with each other, as required. In this way the conductor mass is also increased so that the desired extension (towards the low-frequency end) of the operating frequency range is obtained.

As all of the foils are driven in phase the air volume between two adjoining foils also results in the foils being subjected to a higher mechanical damping, which further reduces undesired resonant modes of the foils or the conductors. Again, this leads to a further reduction of the distortion. Moreover, the sensitivity is higher than that of the transducer disclosed in the afore-mentioned United States Patent.

It is to be noted that diaphragms comprising two foils are also disclosed in U.S. Pat. No. 1,403,849 and German Patent Specification No. 595,574. However, these diaphragms are not intended for use in a transducer of the ribbon-type because there is no mention of a conductor on one or both foils.

FIG. 18 of U.S. Pat. No. 3,873,784 shows a transducer with a diaphragm comprising two foils. Here, only one foil carries a conductor. Moreover, the connecting portions between the two foils contribute to an increase of the moving mass of the diaphragm so that the sensitivity (efficiency) of the transducer is reduced.

Preferably, the conductors are dimensioned so that all foils are driven with at least substantially equal amplitude. This may for example be achieved by providing all the foils with identical conductors.

In another preferred embodiment of the invention the volume enclosed between two foils contains a damping material, for example glass wool. This may lead to a further incease in damping and a further reduction of the distortion in the transducer output signal.

Figure 2:
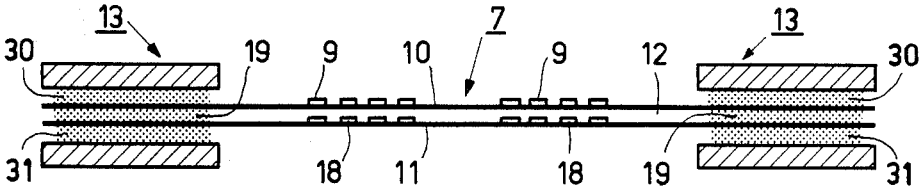
Figure 3:
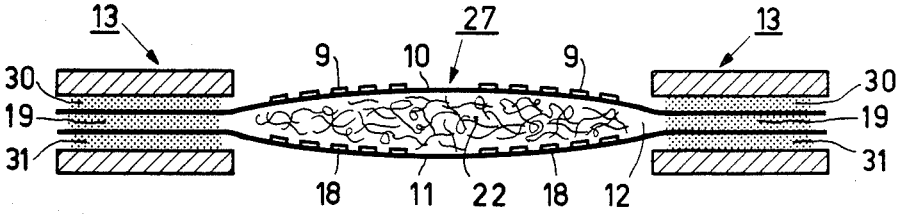

Embodiments of the invention will now be described in more detail, by way of example, with reference to the drawing. In the drawing:

FIG. 1 shows an example of an electro-acoustic transducer of the ribbon-type, FIG. 2 shows the diaphragm of the electro-acoustic transducer shown in FIG. 1, and FIG. 3 shows another diaphragm for use in the electro-acoustic transducer shown in FIG. 1.

FIG. 1 is a sectional view of a ribbon-type electro-acoustic transducer which may be of circular or rectangular shape. In the last-mentioned case FIG. 1 is a sectional view of the transducer taken in a direction perpendicular to the longitudinal direction of the conductor in an air gap. The magnet system of the transducer comprises a centre pole 1, a pole plate 2, 3, a pole plate 4 and members 5 and 6. The magnetic field in the magnet system can be obtained by the use of permanent magnets for the members 5 and 6. The directions of magnetization are indicated by the arrows 20 and 21. The directions of magnetization may also be reversed. The other parts of the magnet system are made of a soft-magnetic material, for example soft iron. In the rectangular version 5 and 6 are cross-sections of two bar-shaped magnets which are arranged parallel to each other. Alternatively, the members 5 and 6 may be made of a soft-magnetic material and the centre pole 1 (or a part thereof) may be constructed as a permanent magnet.

In the circular version an air gap 8 is formed between the pole plate 2, 3 and the centre pole 1. The air gap 8 and the pole plate 2, 3 are then annular. In the rectangular version air gaps 8 are formed between the pole plate 2 and the centre pole 1 and between the pole plate 3 and the centre pole. These air gaps, as well as the pole plates, extend parallel to each other. In the air gap (air gaps) 8 a diaphragm 7 is arranged. The diaphragm comprises two foils 10 and 11 on each of which at least one conductor 9 and 18 respectively is disposed. The conductors extend across the diaphragm surface in a direction perpendicular to the plane of the drawing. FIG. 1 shows for each foil either four conductors which extend parallel to each other across the foil surface in air gap, or one conductor which extends across the foil surface as four turns of a "spiral" around the centre pole. The conductors are connected to an audio amplifier (not shown) in such a way that the signal currents in the conductor(s) 9 and 18 between the pole plate 2 and the centre pole 1 flow perpendicularly to (namely into) the plane of the drawing and that the signal currents in the conductor(s) 9 and 18 between the pole plate 3 and the centre pole 1 flow in the opposite direction, i.e. perpendicularly to (and out of) the plane of the drawing. Since the magnetic field in the air gap 8 between the pole plate 2 and the centre pole 1 extends within or parallel to the diaphragm surface and is oriented oppositely to the magnetic field in the air gap 8 between the pole plate 3 and the centre pole 1, the excursion of the diaphragm and the foils will be substantially in phase over the entire surface area. Therefore, this transducer is also referred to as an isophase transducer. The diaphragm 7 comprises at least two foils which all extend substantially parallel to each other in the diaphragm plane, two adjacent foils being joined to each other, preferably at their circumference, in a substantially air-tight manner so as to provide a space therebetween (i.e. so as to enclose a volume). FIG. 1 shows a diaphragm comprising two foils 10 and 11 enclosing a volume 12. The foils are mounted in a frame 13 in such a way that the sealed spaced or volume 12 is obtained. For three foils two such volumes would be obtained etc.

FIG. 2 shows the diaphragm 7 on a slightly enlarged scale, which diaphgram is used in the transducer shown in FIG. 1. The diaphragm 7 comprises two foils 10 and 11 on each of which a conductor 9 or 18 is arranged. The two foils 10 and 11 are now spaced from each other by a layer of glue 19, the reference numerals 30 and 31 also denoting layers of glue. The shape of the conductor 18 and its arrangement on the foil 11 may be the same as for the conductor 9 on the foil 10. Both conductors receive the same signal from the afore-mentioned audio amplifier, which is not shown. This means that the directions of the signal currents through the conductors 9 and 18 are the same at the location where they are disposed on the left-hand part of the diaphragm in FIG. 2. It is obvious that this also applies to the signal currents through the conductors 9 and 18 at the location where they are disposed on the right-hand part of the diaphragm, but this direction is opposite to the direction through the conductors on the left-hand part of the diaphragm. Therefore, both foils move in phase with each other in the same direction over their entire surface area.

Moreover, the conductors 9 and 18 are preferably of identical shape so that both foils are driven with equal amplitudes. It is obvious that conductors of different non-identical shapes can be used which yet enable both foils to be driven with equal amplitudes.

FIG. 3 shows another diaphragm 27 on a slightly enlarged scale. In the present case the space 12 contains a damping material 22, for example glass wool. The directions of the signal currents are the same as described for the conductors 9 and 18 in FIG. 2.

It is to be noted that the invention is not limited to the embodiments shown in the Figures. The invention may also be applied to transducers which differ from the embodiments shown with respect to points which are not relevant to the inventive idea. For example, the diaphragms shown in the Figures may also be employed in the ribbon-type transducer described in the U.S. Pat. No. 4,484,037.

What is claimed is:

1. An electro-acoustic transducer of the ribbon-type comprising: a magnet system having a pole plate and a centre pole between which at least one air gap is formed, a diaphragm arranged in the air gap and which comprises two or more foils which all extend substantially parallel to each other in the diaphragm plane, every two adjacent foils being joined to each other at the periphery thereof in a substantially air-tight manner so as to provide a space therebetween, and a conductor arranged on each of the foils with the conductors electrically arranged such that all of the foils move at least substantially in phase with each other when an electric signal is applied to the transducer.

2. An electro-acoustic transducer as claimed in claim 1, characterized in the that the conductors are dimensioned so that all of the foils are driven with at least substantially equal amplitudes when an electric signal is applied to the transducer.

3. An electro-acoustic transducer as claimed in claim 1 wherein the space enclosed between the two foils contains a damping material.

4. An electro-acoustic transducer as claimed in claim 3, wherein the damping material comprises glass wool.

5. An electro-acoustic transducer as claimed in claim 2 wherein the space enclosed between the two foils contains a damping material.

* * * * *